US005372486A

United States Patent [19]

Wehling

[11] Patent Number: 5,372,486

[45] Date of Patent: Dec. 13, 1994

[54] PERISTALTIC PUMP

[75] Inventor: Werner Wehling, Dorsten, Germany

[73] Assignee: Allweiler AG, Radolfzell, Germany

[21] Appl. No.: 59,707

[22] Filed: May 10, 1993

[30] Foreign Application Priority Data

May 11, 1992 [DE] Germany ..... 4214914

[51] Int. Cl.[5] ..... F04B 43/08

[52] U.S. Cl. ..... 417/477.8; 417/477.3

[58] Field of Search ..... 417/475, 476, 477

[56] References Cited

U.S. PATENT DOCUMENTS

| | | | |
|---|---|---|---|
| 537,049 | 4/1895 | Lewis | 417/476 |
| 2,123,781 | 7/1938 | Huber | 417/476 |
| 3,384,080 | 5/1968 | Muller | 417/477 |
| 3,386,382 | 6/1968 | Schnette et al. | 417/477 |
| 3,565,286 | 2/1971 | Latham et al. | 417/477 |
| 4,218,197 | 8/1980 | Meyer et al | 417/477 |
| 4,518,327 | 5/1985 | Hackman | 417/477 |

*Primary Examiner*—Richard A. Bertsch
*Assistant Examiner*—M. Kocharov
*Attorney, Agent, or Firm*—Bachman & Pointe

[57] ABSTRACT

In a peristaltic pump having a pump tube with an elastically deformable wall, which tube is arranged in a pump housing and has externally accessible connection ends and is fitted into the pump housing with a region which is curved in part-circular configuration around a shaft of a rotor of the peristaltic pump and at a radial spacing from the shaft, the cross-section of which tube is variable by pressure rollers which project radially from the rotor and which press the pump tube at least in its curved region against a correspondingly curved fixed support, producing a reduction in the internal volume of the tube, the rotor (20) itself has mounting eyes or bores (52) for the roller spindle (54) of the pressure roller (58), which is mounted in the rotor interchangeably in an aligned pair of bores parallel to the shaft (18) of the rotor.

14 Claims, 2 Drawing Sheets

PERISTALTIC PUMP

The invention relates to a peristaltic pump having a pump tube with elastically deformable wall, which tube is arranged in a pump housing and has externally accessible connection ends and is fitted into the pump housing with a region which is curved in a part-circular configuration around a shaft of a rotor of the peristaltic pump and at a radial spacing from the shaft, the cross-section of which tube is variable by pressure rollers which project radially from the rotor and which press the pump tube at least in its curved region against a correspondingly curved fixed support, producing a reduction in the internal volume of the tube.

British patent specification No 628 785 describes a peristaltic pump of that kind, having a pump tube and a pair of pressure rollers which in the interior of the tube produce a chamber portion which is closed off by two squeeze locations. When the rotor rotates the pressure rollers roll against the stationary pump tube which is supported against the support, and the above-mentioned squeeze locations also move along with the pressure rollers, whereby the fluid or like material being conveyed, which is present in the interior of the tube, is conveyed from the tube intake to the discharge end of the pump tube; the squeeze location adjacent the tube intake, by virtue of the return force of the tube wall, produces a suction force on the incoming material to be conveyed, which is then transported by the above-described chamber portion to the discharge end of the pump tube.

In accordance with British patent specification No. 628 785 the radial spacing of the rollers relative to the shaft of the rotor is variable as the roller spindles are carried by a displaceable carrier. The carrier is moved parallel to the shaft and at an angle to a straight line through the central axis of the shaft and the roller spindle. Such a construction is disadvantageous in particular when adjustment is not made by an expert and the adjustment effected is therefore possibly wrong; fluctuating pressure roller adjustment is difficult to control and results in different pump outputs depending on the respective pressure roller stroke movement, and in addition pulsation is increased. In the state of the art, inclined positioning of the pressure roller spindle or pressure roller is possible due to play between the rotor and the pressure roller carrier, with the result of an increased level of loading and a reduction in the service life of the pump tube, high production expense and increasing manufacturing costs. Particularly when dealing with dirty or corrosive media, bursting or cracking of a pump tube can result in extremely undesirable contamination of the area around the pump.

In consideration of that state of the art the inventor set himself the aim of providing a peristaltic pump of the kind set forth in the opening part of this specification, with which the acknowledged deficiencies are eliminated.

By virtue of the features according to the invention the possibility of different pressure roller adjustments is eliminated; the adjustment can be easily carried out and is simple to check. Irregular pump output for each pressure roller stroke movement is prevented, and a limitation on the pulsation effect is also achieved. In accordance with the stated object the reduction in service life of the pump tube due to inclined positioning of the pressure rollers is avoided and production expense and manufacturing costs are considerably reduced.

In the peristaltic pump according to the invention the rotor itself has mounting eyes or bores for the roller spindle of the pressure roller, which is mounted in the rotor interchangeably in an aligned pair of bores parallel to the shaft of the rotor.

In accordance with a further feature of the invention the aligned pairs of bores are disposed in two rotor plates of the rotor, which are arranged at an axial spacing relative to each other. The rotor plates are advantageously integral with a central web portion of the rotor, which accommodates the shaft, and preferably afford in the region of the bores part-circular outer edges beyond which a part of the pressure roller cross-section radially projects.

Each of the rotor plates is provided with a plurality of bores which are disposed one beside the other on a respective construction circle around the shaft, wherein two bores of each rotor plate lie on a common construction circle, and in addition in accordance with the invention on a common diameter.

The radii of the construction circles are of different lengths, and the length of the radii also increases stepwise in a direction, preferably by about 0.5 to 1.5 mm in each case, in particular in opposite relationship to the direction of rotation of the rotor.

That step of radially displacing the roller spindle mountings permits different pressure roller adjustment in a simple fashion. As a spacing from each other in respect of the bores which are provided near the outer edges, it is possible to refer to the angle between their spacing radii relative to the axis of the shaft, which is between 20° and 30°, preferably about 28°. In accordance with another feature of the invention the roller spindles of two pressure rollers are fixed by a common spindle holder, advantageously by a rigid material strip having two blade ends, which is held centrally at the axis of the pump shaft, for example by an end screw on the pump shaft, and which with its two blade ends engages the roller spindles. If the spindle holder is also secured to the roller spindles by end screws, that provides a securing action in only one direction. It is therefore of particular significance that the free ends of the spindle holder are inserted as retaining web portions in lateral retaining grooves in the two roller spindles; that permits both radial and also axial fixing and in a particular effective fashion prevents a differing pressure roller arrangement and adjustment.

Preferably the retaining ends of the spindle holder engage with aligned retaining edges into the retaining grooves and can therefore be inserted from one side into both retaining grooves. The abovementioned end screw which additionally holds it at the center of the rotor provides a kind of three-point fixing and prevents misassembly of the spindle holder.

For the sake of improved handling, the pressure roller adjustments, of which there are four in the illustrated embodiment, are identified on the rotor with hammered-in figures or letters.

The fact that the pressure roller or pressure roller spindle is directly mounted in the rotor excludes inclined positioning of the pressure rollers and that therefore prevents a reduction in the service life of the pump tube.

It will be appreciated that a reduction in the number of components and a simplification in terms of design configuration and production procedure is achieved, which results in a reduction in manufacturing expenditure and production costs.

Further advantages, features and details of the invention will be apparent from the following description of a preferred embodiment and with reference to the drawing in which.

Figure 1:
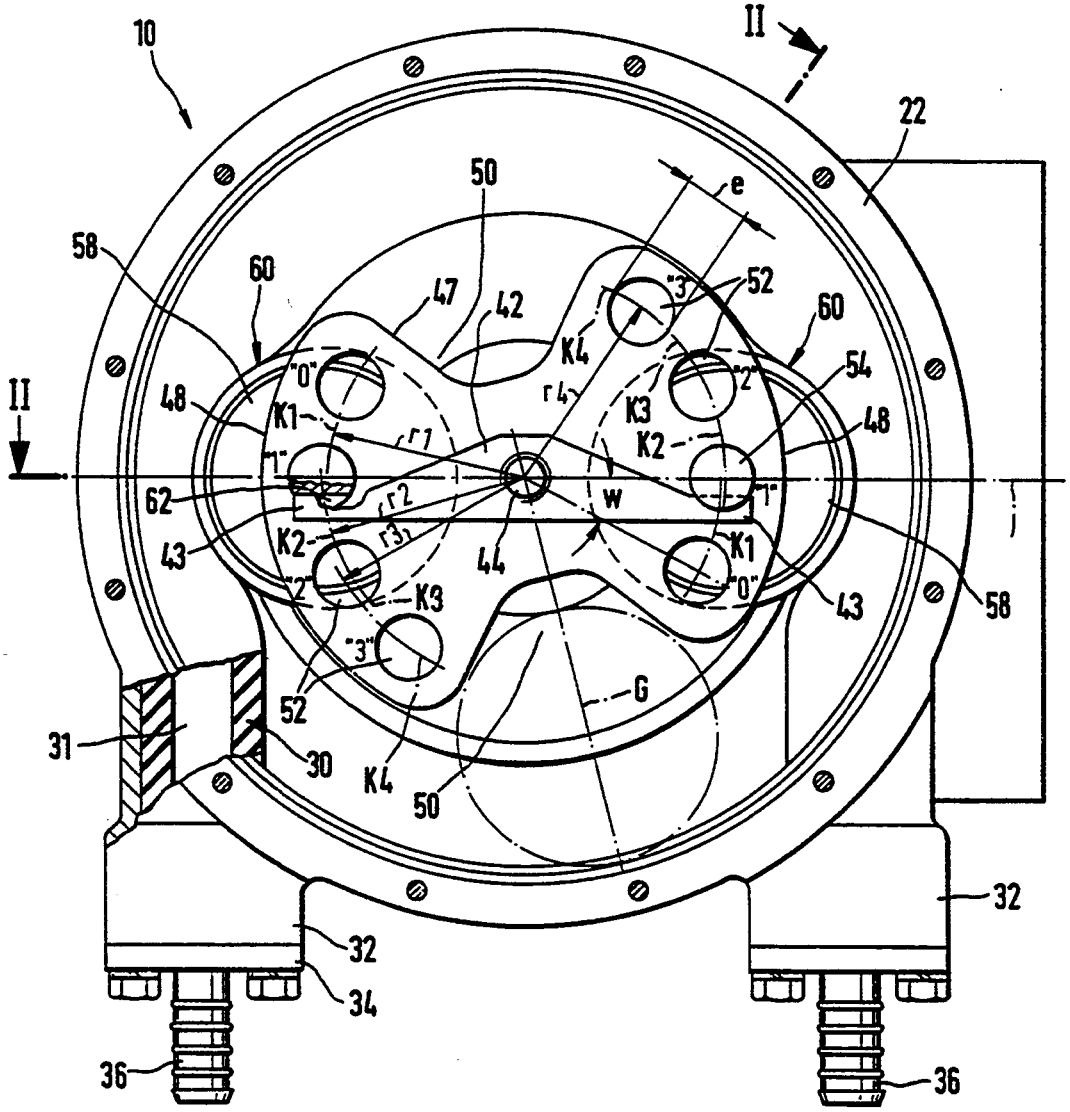
FIG. 1 is a plan view of a pump partly in section.

A peristaltic pump 10 for conveying fluid, granular material or the like medium, which is laterally fixed to a drive which is only indicated in the drawing, has a rotor 20 on a pump shaft 18 in a dish-shaped pump housing 12 of an inside diameter d of about 320 mm and an inside height h of about 100 mm, with a housing wall 16 which stands up from a housing bottom 14. The housing wall 16 terminates at an outwardly projecting flange 22 on to which a pump cover 26 is screwed with the interposition of a seal 24. The pump cover 26 with the pump housing 12 encloses a pump chamber 28 which in the case of wet rotors can accommodate lubricant or coolant.

In particular FIG. 1 shows that arranged at the inside surface of the housing wall 16 is a pump tube 30 of substantially U-shaped configuration in plan view. The free ends of the tube 30 project into two wall connections 32 on the housing wall 16, which are each closed by means of a respective gland 34 which is screwed in position. Passing through each gland 34 is a fixed tubular pump connection 36, as intake and outlet for a medium to be conveyed, which is fitted at the tube end into the tube interior 31.

The mutually parallel wall connections 32 project approximately tangentially from the housing wall 16 and accommodate packing rings, gland base rings and the like which are not shown for the sake of clarity of the drawing.

The disk-like rotor 20 is of I-like cross-section. The pump shaft 18 is carried in the central web portion 38 of that cross-section, in a central mounting bore 40 in the rotor 20. The mounting bore 40 has extending thereover a blade-like strip as a spindle holder 42, against the outside of which bears the head of an end screw 44 in the pump shaft 18. The usual screw securing means are not particularly mentioned here, that of the screw 44 is identified by 45.

Projecting from the central web portion 38 radially at a spacing i from each other are two parallel rotor plates 46, 47 which are integral with the central web portion 38 and which, as shown in plan view in FIG. 1, each have two approximately oval regions which are connected by a central limb portion and which on both sides of a straight line of symmetry G afford two part-circular outer edges 48 and which in the limb region define two mutually oppositely disposed recesses 50.

Each of the oval regions is provided with—in this case four—bores 52 (numbered in FIG. 1 as '0' to '3') of a diameter e of about 25 mm, on different construction circles K1 through K4; the radii r1 through r4 thereof are respectively stepped by about 0.5, with the radius r1 here measuring about 80 mm. The same spacing angles w between radial lines of adjacent bores 52 are between 26° and 28°.

Figures 2, 3:
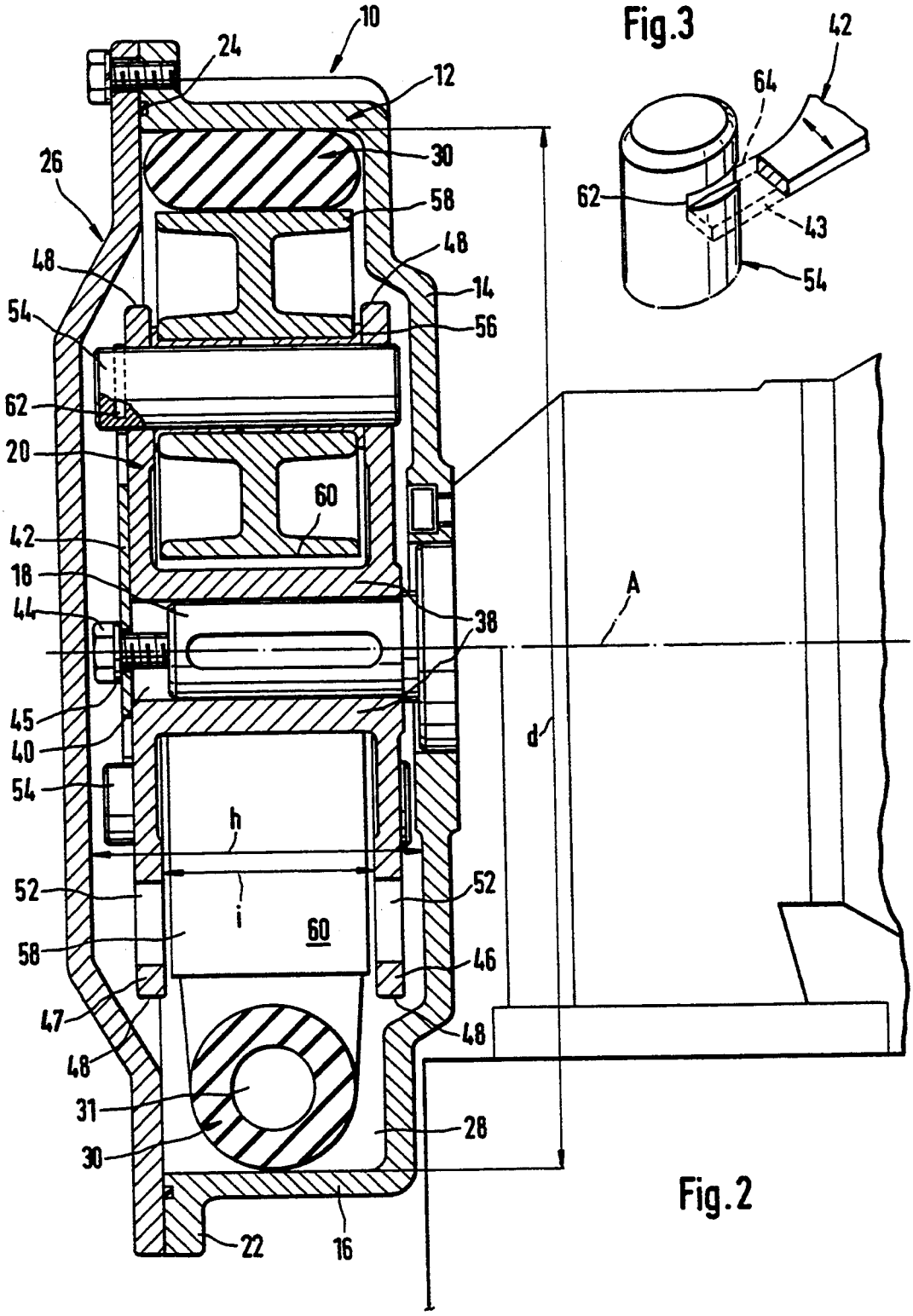
FIG. 2 shows the section through FIG. 1 taken along line II—II therein.
FIG. 3 is a perspective view of a detail from FIG. 2 on an enlarged scale.

The two bores 52 with the numbering '1' receive roller spindles 54 which are parallel to the pump shaft 18, in the illustrated embodiment. The roller spindles 54 are each surrounded between the rotor plates 46, 47 by a respective bearing bush 56 of a pressure roller 58. They present an H-shaped profile cross-section on each side of the bearing bush 56 in FIG. 2.

The periphery 60 of the two pressure rollers 58 which lie on a common diameter D rolls, when the pump shaft 18 rotates, against the side of the pump tube 30 which is supported against the inside surface of the housing wall 16, and so squashes together the cross-section of the pump tube 30 that the volume of the tube interior 31 approaches the value of zero until the tube interior 31 is closed at the squeeze location. The chamber portion which is produced in that way provides for further transportation of the medium to be conveyed, as the rotor rotates.

The two roller spindles 54 are directly mounted at both ends in the rotor 20, and their mounting bores 52 lie at the same spacing relative to the axis A of the pump shaft 18 in the rotor plates 46, 47, in addition, as stated, on the common diameter D. Radial and axial fixing of the roller spindles 54 is provided by the blade-like spindle holder 42, the retaining ends 43 of which engage into radial peripheral slots or retaining grooves 62 in the roller spindles 54. As FIG. 1 clearly shows, the spindle holder 42 is mounted at the screw 44 on the one hand and in the retaining grooves 62 on the other hand, that is to say at three points, and its mutually aligned retaining edges 64 which are to be fitted into the retaining grooves 62 lie on a common side of the spindle holder 42.

I claim:

1. A peristaltic pump having a rotor which rotates about a shaft, said rotor having a pair of flanges defining a space in which a portion of a pair of pressure rollers reside, each of said pressure rollers projecting radially from said rotor and having a roller spindle adjacent each end, each of said flanges having a first portion and a second portion, a pump tube with an elastically deformable wall, said tube being arranged in a pump housing and having externally accessible connection ends, said pump tube being fitted into the pump housing within a region which is curved in a part-circular configuration around the shaft of the rotor and at a radial spacing from the shaft, said tube having a cross-section which is varied by said pressure rollers which project radially from the rotor and which press the pump tube at least in its curved region against a correspondingly curved fixed support thereby producing a reduction in the internal volume of the tube, and means for varying the volumetric capacity of the pump, said varying means comprising each of said first and second portions having first and second bores positioned adjacent each other with said bores lying in respective construction circles with the radii of said construction circles being of different lengths, each of said bores being sized to receive one of said roller spindles, said varying means further comprising a bore within said first portion of each flange being disposed on a common diameter with a bore in said second portion of each flange, and said varying means further comprising means for securing said rotor spindles in selected ones of said bores in said first and second portions, whereby the degree to which the tube is pressed in determined by the positioning of the rotor spindles within the selected ones of said bores.

2. A pump as set forth in claim 1 characterised by two rotor plates (46, 47) arranged at an axial spacing (i) relative to each other and said plurality of mounting bores being present in each of said rotor plates with said bores in a first one of said plates being aligned with said bores in a second one of said plates.

3. A pump as set forth in claim 2 characterised in that the rotor plates (46, 47) are integral with a central web portion (38) of the rotor (20), the central web portion accommodating the shaft (18) in a mounting bore (40).

4. A pump as set forth in claim 3 characterised in that in the region of the bores (52) the rotor plates (46, 47) have part-circular outer edges (48) beyond which a part of the pressure fuller cross-section projects.

5. A pump as set forth in claim 4 characterised in that each roller spindle (54) is surrounded by a bearing bush (56) between the two rotor plates (46, 47).

6. A pump as set forth in claim 1 characterised by an angle (w) of between 20° and 30° as the spacing for adjacent one of said bores (52).

7. A pump as set forth in claim 1 characterised in that the length of the radii (r1–r4) increases stepwise in a direction 8. A pump as set forth in claim 7 characterised in that the length of the radii (r1–r4) increases in opposite relationship to the direction of rotation of the rotor (20).

9. A pump as set forth in claim 7 characterised in that the length of the radii increases in each case by about between 0.5 mm and 1.5 mm.

10. A peristaltic pump having a pump tube with an elastically deformable wall, said tube being arranged in a pump housing and having externally accessible connection ends, said pump tube being fitted into the pump housing within a region which is curved in a part-circular configuration around a shaft of a rotor of the peristaltic pump and at a radial spacing from the shaft, said tube having a cross-section which is variable by pressure rollers which project radially from the rotor and which press the pump tube at least in its curved region against a correspondingly curved fixed support, thereby producing a reduction in the internal volume of the tube, the rotor (20) having a plurality of mounting eyes or bores (52) for at 11. A pump as set forth in claim 10 characterised by a rigid material strip as the spindle holder (42), which is held on the axis (A) of the pump shaft (18) and which with its two ends engages the roller spindles (54).

12. A pump as set forth in claim 11 characterised in that the free ends (43) of the spindle holder (42) are of a bladelike configuration and as retaining limb portions are inserted into lateral retaining grooves (62) in the two roller spindles (54).

13. A pump as set forth in claim 12 characterised in that the retaining ends (43) of the spindle holder (42) engage with aligned retaining edges (64) into the retaining grooves (62) of the roller spindles (54).

14. A pump as set forth in claim 12 characterized in that the spindle holder (42) is held on an axis (A) of the pump shaft and at the two retaining grooves (62) in a kind of three-point fixing.

* * * * *

UNITED STATES PATENT AND TRADEMARK OFFICE

CERTIFICATE OF CORRECTION

PATENT NO. : 5,372,486

DATED : December 13, 1994

INVENTOR(S) : Werner Wehling

It is certified that error appears in the above-indentified patent and that said Letters Patent is hereby corrected as shown below:

In line 5 of the Abstract, on the cover page, insert —a— between "in" and "part-circular".

In Column 5, claim 4, line 10, "fuller" should be —roller—.

In Column 6, claim 10, line 10, after "at" insert the following:

—least one pair of roller spindles (54) associated with pressure rollers (58) and said spindles being mounted in the rotor parallel to the shaft (18) of the rotor, said plurality of mounting bores including first and second bores (52) disposed in the rotor (20) with said first and second bores being beside one another on respective construction circles around the shaft, and further including at least two bores disposed on a common diameter (D) and a common construction circle, the radii of the construction circles being of different lengths, two rotor plates (46, 47) arranged at an axial spacing (i) relative to each other, said plurality of mounting bores being present in each of said rotor plates with said bores in a first one of said plates being aligned with said bores in a second one of said plates, the rotor plates (46, 47) being integral with a central web portion (38) of the rotor (20), the central web portion accommodating the shaft (18) in a mounting bore (40), said pump further being characterized in that in the region of the bores (52) the rotor

UNITED STATES PATENT AND TRADEMARK OFFICE

CERTIFICATE OF CORRECTION

PATENT NO. : 5,372,486

DATED : December 13, 1994

INVENTOR(S) : Werner Wehling

It is certified that error appears in the above-indentified patent and that said Letters Patent is hereby corrected as shown below:

plates (46, 47) having part-circular outer edges (48) beyond which a part of the pressure roller cross-section projects, each roller spindle (54) being surrounded by a bearing bush (56) between the two rotor plates (46, 47) and said roller spindles (54) of two pressure rollers (58) are fixed by a common spindle holder (42).—.

In Column 6, claim 12, line 17, "bladelike" should be —wing-like—.

Signed and Sealed this

Ninth Day of May, 1995

*Attest:*

BRUCE LEHMAN

*Attesting Officer*

*Commissioner of Patents and Trademarks*